US011250974B2

(12) United States Patent
Wong

(10) Patent No.: US 11,250,974 B2
(45) Date of Patent: Feb. 15, 2022

(54) CABLE WITH AEROGEL DIELECTRIC

(71) Applicant: Fractal, Inc., Aurora, CO (US)

(72) Inventor: Jason Wong, Aurora, CO (US)

(73) Assignee: Fractal, Inc., Aurora, CO (US)

( * ) Notice: Subject to any disclaimer, the term of this patent is extended or adjusted under 35 U.S.C. 154(b) by 0 days.

(21) Appl. No.: 16/914,404

(22) Filed: Jun. 28, 2020

(65) Prior Publication Data

US 2021/0407707 A1 Dec. 30, 2021

(51) Int. Cl.
*H01B 7/02* (2006.01)
*H01B 9/02* (2006.01)
*H01B 1/02* (2006.01)

(52) U.S. Cl.
CPC ..... *H01B 9/02* (2013.01); *H01B 1/02* (2013.01); *H01B 7/0216* (2013.01)

(58) Field of Classification Search
CPC ..... H01B 3/00; H01B 7/221; H01B 9/025; H01B 11/1041
See application file for complete search history.

(56) References Cited

U.S. PATENT DOCUMENTS 2,009,004 A * 7/1935 Schatzel ..... H01B 7/295 174/121 A
6,127,632 A * 10/2000 Oswald ..... H01B 7/046 174/120 R
6,246,006 B1 * 6/2001 Hardin ..... H01B 11/1091 174/106 R
7,754,121 B2 * 7/2010 Ristic-Lehmann ..... B32B 27/18 264/120
9,214,260 B2 * 12/2015 Ishikawa ..... H01B 11/1895
9,972,420 B2 * 5/2018 Hasan ..... C01B 32/158
2005/0143515 A1 * 6/2005 Ristic-Lehmann ..... C08K 3/22 524/544
2013/0248222 A1 * 9/2013 Inaba ..... A61B 1/00114 174/107
2015/0083459 A1 * 3/2015 Nagahashi ..... H01B 9/02 174/107
2017/0245380 A1 * 8/2017 Yun ..... H01L 23/36
2018/0053583 A1 * 2/2018 Koliatene ..... H01B 7/28
2019/0103547 A1 * 4/2019 Mackertich-Sengerdy ..... H01L 41/0838
2019/0390025 A1 * 12/2019 Sakaguchi ..... C08J 5/046

FOREIGN PATENT DOCUMENTS

WO WO 2020/101809 * 5/2020

* cited by examiner

*Primary Examiner* — Chau N Nguyen
(74) *Attorney, Agent, or Firm* — Josiah Barbour

(57) ABSTRACT

The present invention is a cable made from a braided polyethylene terephthalate cable sleeve. Inside the cable sleeve is a sequence of four shielding layers; a braided copper wire layer, a braided silver-plated copper wire layer, and two braided carbon fiber layers. Within the fourth shielding layer is a polytetrafluoroethylene inner sleeve containing a particulate aerogel dielectric, with an approximate particle diameter from 2 micrometers to 1.2 millimeters, and a conductive metal core with a mirror polish.

2 Claims, 4 Drawing Sheets

CABLE WITH AEROGEL DIELECTRIC

BACKGROUND

Field of the Invention

The present invention relates generally to cables for audio, video, data, and electricity transmission. More specifically, the present invention relates to a cable with an aerogel dielectric.

Description of the Related Art

Typical cable construction is a solid metal core conductor, typically made from aluminum or copper, but silver is occasionally used, housed within a dielectric composed of foamed polyethylene or polytetrafluoroethylene. This is then shielded with a variety of shielding layers, depending on the amount of radio frequency interference and electromagnetic interference isolation needed for the particular cable. These shielding layers are typically constructed from foil aluminum or copper, braided aluminum or copper, or even stainless steel.

SUMMARY

In accordance with the embodiments herein, a cable with an aerogel dielectric is disclosed. The cable described herein has an aerogel dielectric surrounding the conductive metal core of the cable. Typically, but not necessarily, the aerogel will be particulate in nature. Additionally, the cable may have outer sleeving, one or more shielding layer, and inner sleeving.

DETAILED DESCRIPTION OF EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention.

Figure 1:
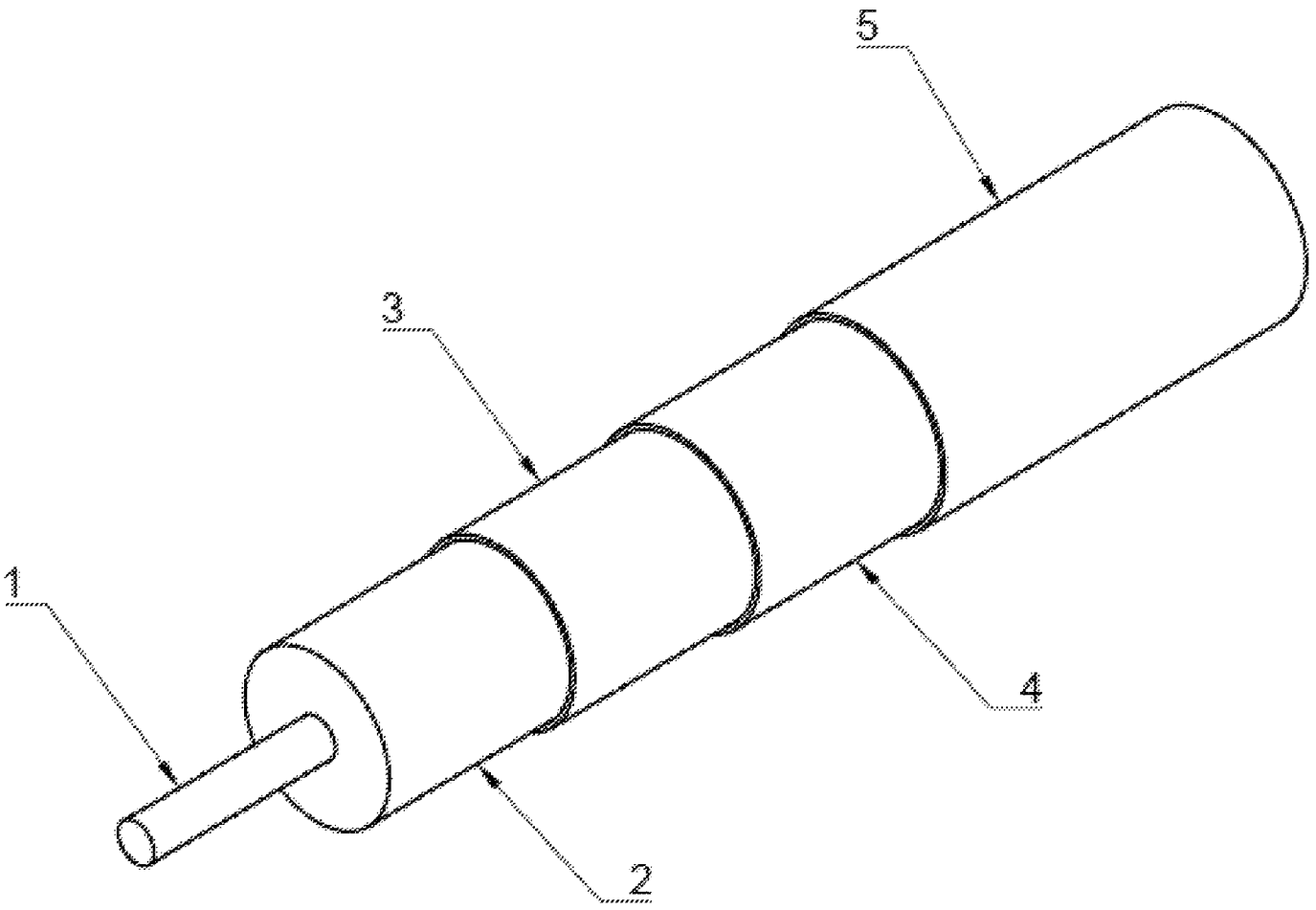
FIG. 1 provides a general view of the cable.

In an illustrative embodiment of the invention, as summarized by FIG. 1, the cable has at least one conductive metal core, 1, surrounded by an aerogel dielectric, 2. Typically, but not required, the aerogel dielectric would be within an inner sleeve, 3, which is inside at least one shielding layer 4; all of which would be inside outer cable sleeve 5. The conductive metal core would typically be made from silver or copper, but other conductive metals are contemplated.

Optionally, the aerogel dielectric could be made from particulate aerogel. If particulate aerogel is used, particles with a diameter from 2 micrometers to 1.2 millimeters is optimal, but other particle sizes could be used.

In embodiments where the outer cable sleeve is present, the outer cable sleeve may be woven or braided. Additionally, the outer cable sleeve may be made from a number of plastics including polyvinylchloride, polyethylene, polyethylene terephthalate, polytetrafluoroethylene, polyurethane, thermoplastic rubber, thermoplastic elastomer, thermoplastic chlorinated polyethylene, or thermoset polyolefin. It would be obvious to one of skill in the art that this is not a complete list of materials useful for making an outer cable sleeve. Additional materials and methods of construction for the outer cable sleeve are contemplated.

For embodiments that include the inner shielding layer, multiple inner shielding layers may be present. The inner shielding layer may be made from copper strands, tin-plated copper strands, silver-plated copper strands, aluminum, bronze, mylar composite tape, carbon fiber, or a combination of the aforementioned materials. The inner shielding layer may be constructed from a foil, a spiral of strands, braided, woven, or even from a tape. It would be obvious to one of skill in the art that this is not a complete list of materials useful for making an inner shielding layer. Additional materials and methods of construction for the inner shielding layer are contemplated.

Embodiments that include the inner sleeve have an inner sleeve that is typically made from a dielectric compound such as polyvinylchloride, polyethylene, cross-linked polyethylene, rubber, elastomer, ethylene propylene rubber, polytetrafluoroethylene, or thermosetting compound. Typically, the inner sleeve would be constructed in a braided, woven, or spiral fashion. It would be obvious to one of skill in the art that this is not a complete list of materials useful for making an inner sleeve. Additional materials and methods of construction for the inner sleeve are contemplated.

Some embodiments of the cable may additionally include a wire for power transmittal somewhere within the outer cable sleeve. This embodiment would be useful for situations such as if this cable were to be used for USB transmittal, which includes both data and power transmission within the cable.

Figure 2:
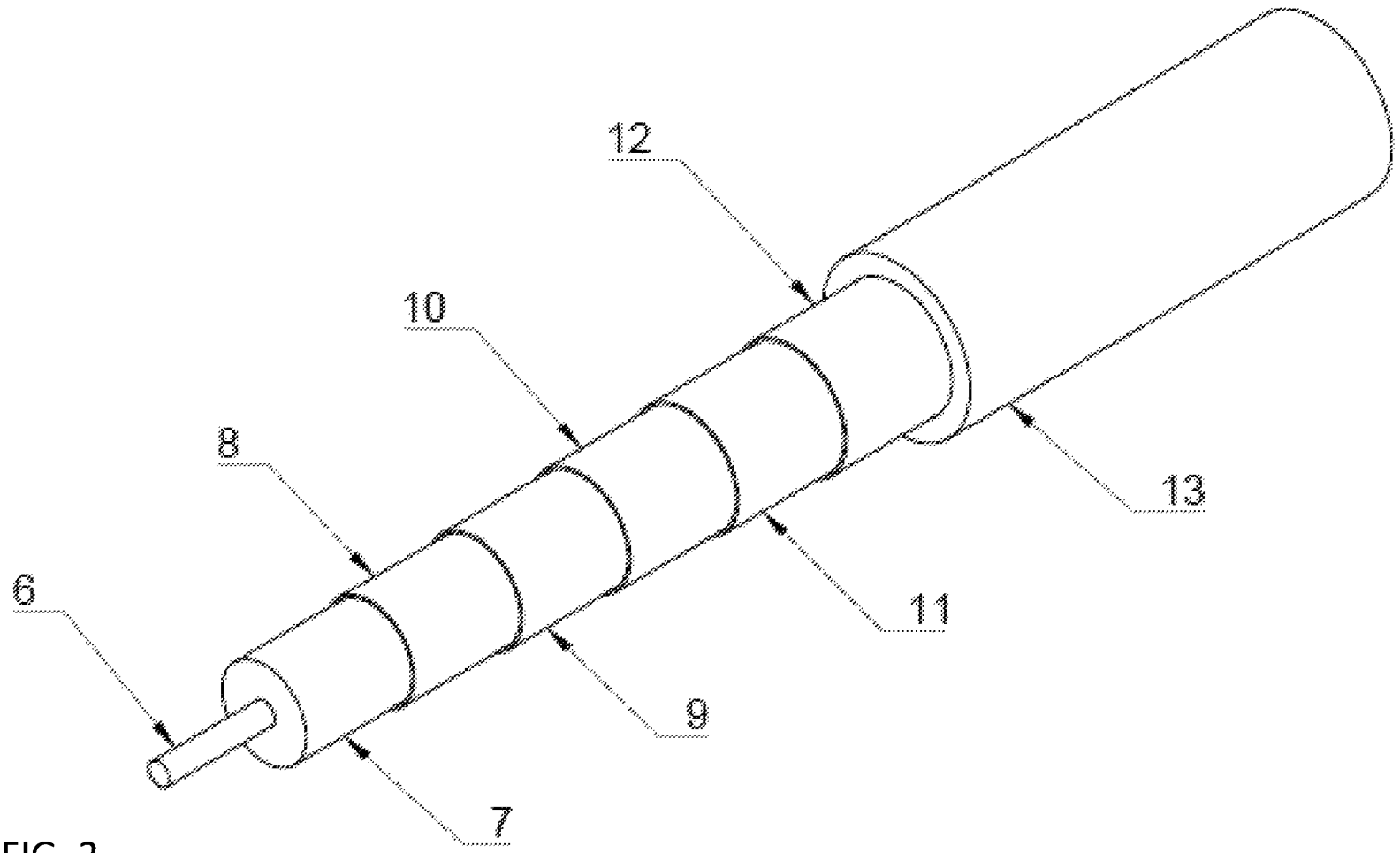
FIG. 2 provides a specific view of an embodiment of the cable.

In a specific embodiment, as seen in FIG. 2, the cable would comprise a cable sleeve, 13, made from braided polyethylene terephthalate. Inside the cable sleeve is a first shielding layer, 12, made from braided copper wire, which has a second shielding layer, 11, made from braided silver-plated copper wire inside it. Within the second shielding layer is a third shielding layer, 10, made from braided carbon fiber with a fourth shielding layer, 9, also made from braided carbon fiber, inside the third shielding layer. Within the fourth shielding layer is a polytetrafluoroethylene inner sleeve, 8. Inside the polytetrafluoroethylene inner sleeve is a particulate aerogel dielectric, 7, with an approximate particle diameter from 2 micrometers to 1.2 millimeters, and a conductive metal core, 6, polished to a mirror polish. The conductive metal core is typically made from silver or copper, but other conductive metals are contemplated.

Figure 3:
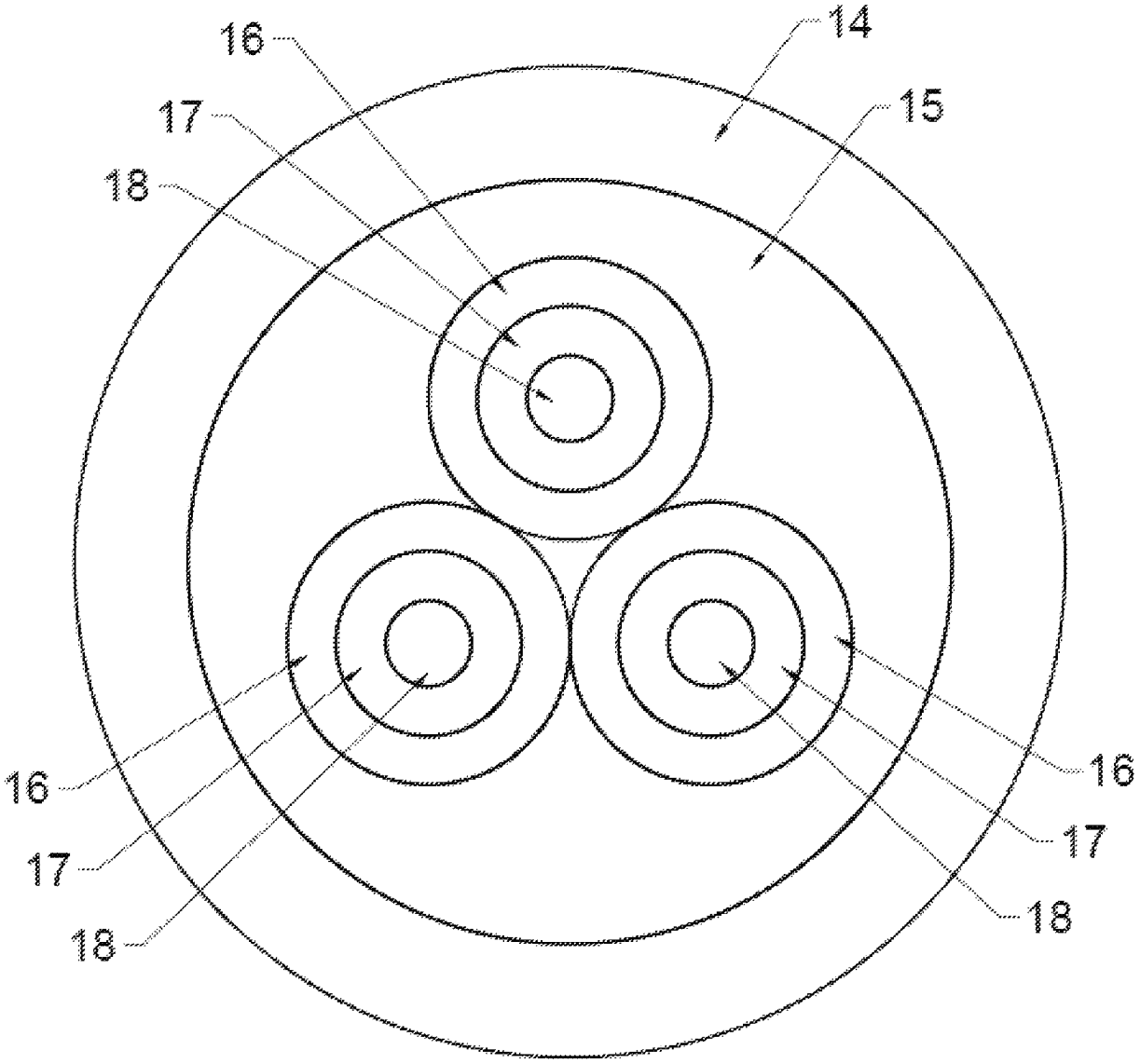
FIG. 3 provides an end-view of the cable in a configuration with multiple wires through the cable.

In a different embodiment, the cable may have multiple conductive metal cores, as seen in FIG. 3. In this embodiment, each conductive metal core, 18, would be housed within its own aerogel dielectric layer, 17, which would then be inside an inner sleeve, 16. This is then within at least one shielding layer, 15, which is inside a cable sleeve, 14. In FIG. 3, this embodiment is seen with three conductive metal cores. This is only an illustrative example. It is understood that any number of conductive metal cores could be used in this fashion.

Figure 4:
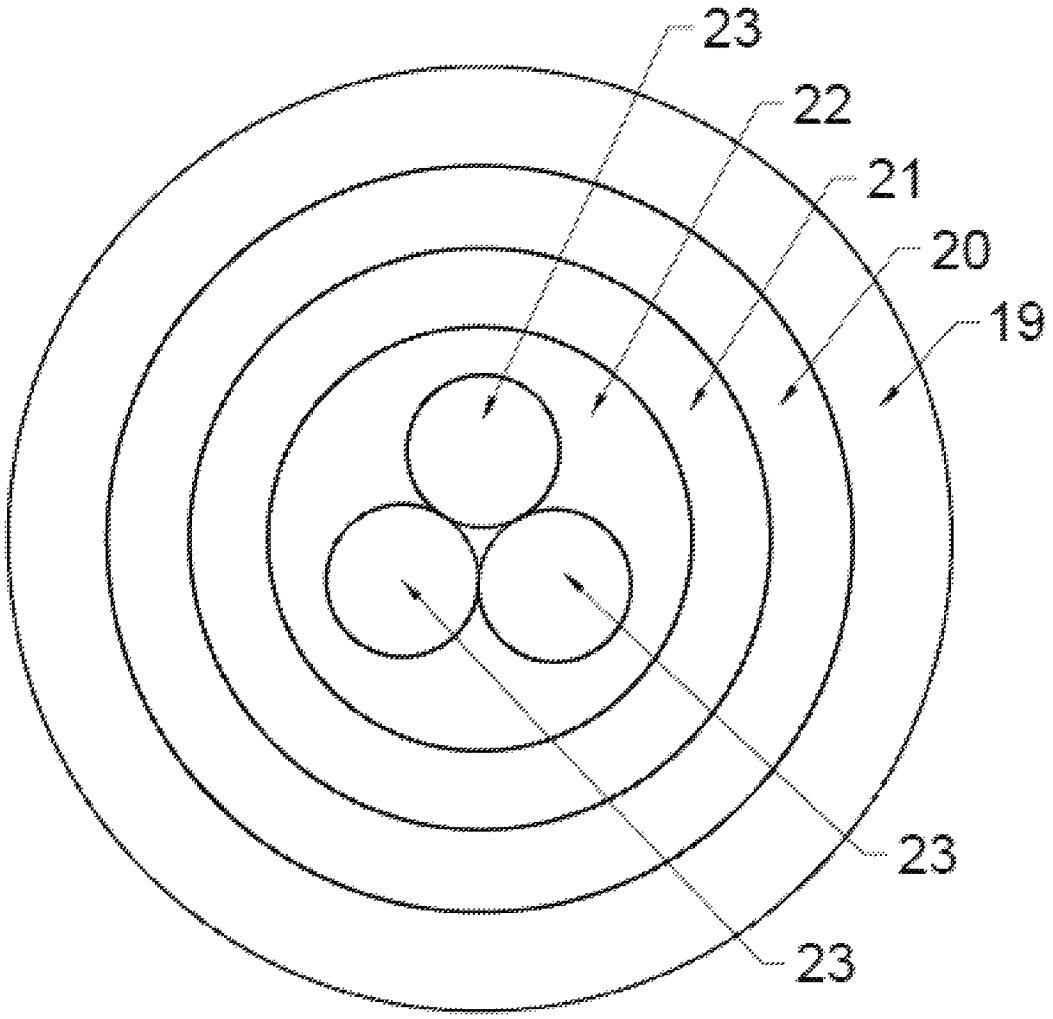
FIG. 4 provides an end-view of the cable in a different configuration with multiple wires through the cable.

In a further embodiment with multiple metal cores, the multiple metal cores could be within a single aerogel dielectric layer, as seen in FIG. 4. In this embodiment, the conductive metal cores, 23, would be within a single aerogel dielectric layer, 22. These would then be inside at least one inner sleeve, 21, which is inside at least one shielding layer, 20. These shielding layers would then all be inside a cable sleeve, 19. In FIG. 4, this embodiment is seen with three conductive metal cores. This is only an illustrative example. It is understood that any number of conductive metal cores could be used in this fashion.

What is claimed is:

1. A cable, comprising:

a layer of cable sleeve made from braided polyethylene terephthalate;

a first shielding layer inside the cable sleeve made from braided copper wire;

a second shielding layer inside the first shielding layer made from braided silver-plated copper wire;

a third shielding layer positioned inside the second shielding layer made from braided carbon fiber;

a fourth shielding layer made from braided carbon fiber that is within the third shielding layer; and a polytetrafluoroethylene inner sleeve inside the fourth shielding layer containing:

a particulate aerogel dielectric, wherein the particulate aerogel has an approximate diameter from 2 micrometers to 1.2 millimeters; and at least one conductive metal core polished to a mirror polish.

2. The cable of claim 1, wherein the at least one conductive metal core is selected from the group consisting of silver and copper.

* * * * *